US006475310B1

(12) United States Patent
Dunning et al.

(10) Patent No.: US 6,475,310 B1
(45) Date of Patent: Nov. 5, 2002

(54) OXIDATION RESISTANT ALLOYS, METHOD FOR PRODUCING OXIDATION RESISTANT ALLOYS

(75) Inventors: John S. Dunning, Corvallis; David E. Alman, Salem, both of OR (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/684,655

(22) Filed: Oct. 10, 2000

(51) Int. Cl.[7] ..... C21D 6/00

(52) U.S. Cl. ..... 148/605; 148/611; 148/272; 148/286

(58) Field of Search ..... 148/605, 611, 148/284, 286, 272

(56) References Cited

U.S. PATENT DOCUMENTS 4,063,935 A 12/1977 Fujioka et al.
4,102,225 A 7/1978 Michels
4,108,641 A 8/1978 Fujioka et al.
4,897,132 A * 1/1990 Yamamoto et al. ..... 148/327
5,021,215 A * 6/1991 Sawaragi et al. ..... 420/584.1

FOREIGN PATENT DOCUMENTS

CZ 279825 * 7/1995

* cited by examiner

*Primary Examiner*—Sikyin Ip
(74) *Attorney, Agent, or Firm*—Brian J. Lally; Bradley W. Smith; Paul A. Gottlieb

(57) ABSTRACT

A method for producing oxidation-resistant austenitic alloys for use at temperatures below 800° C. comprising of: providing an alloy comprising, by weight %: 14–18% chromium, 15–18% nickel, 1–3% manganese, 1–2% molybdenum, 2–4% silicon, 0% aluminum and the balance being iron; heating the alloy to 800° C. for between 175–250 hours prior to use in order to form a continuous silicon oxide film and another oxide film. The method provides a means of producing stainless steels with superior oxidation resistance at temperatures above 700° C. at a low cost

9 Claims, 3 Drawing Sheets

OXIDATION RESISTANT ALLOYS, METHOD FOR PRODUCING OXIDATION RESISTANT ALLOYS

CONTRACTUAL RIGHTS TO THE INVENTION

The U.S. Government has certain rights in this invention pursuant to an employment contract between the inventors and the U.S. Department of Energy.

BACKGROUND OF THE INVENTION

1. Field of the Invention

This invention relates to an oxidation resistant steel and method for making same, and more specifically, this invention relates to an oxidation resistant steel and a method for making oxidation resistant steel having superior resistance at 700° C. and at temperatures exceeding 700° C.

2. Background of the Invention

Oxidation rates and mechanisms in numerous metals and alloys have been investigated in various environments. Oxidation characteristics of iron-based materials depend on the alloying elements of those materials and the oxidation environments.

Additions of chromium, manganese, silicon, and aluminum singly or in combination can promote the formation of protective films, such as $MO_2$ oxide, $M_3O_4$ spinels and $M_2O_3$ sesquioxides (where M=Fe, Cr, Mn, Si and/or Al).

Iron base alloys with additions of 13 percent or more chromium are designated stainless steels and in oxidizing environments form a strongly adherent protective chromium oxide over the base metal.

Aluminum and silicon are frequently added to stainless steel in an attempt to improve protective oxide films. In Fe—Cr—Al alloys, oxide layers are formed with aluminum oxide initially forming an outer layer and chromium oxide an inner layer. In Fe—Cr—Si alloys, chromium oxide forms an outer layer with silicon oxide forming a thin inner layer (or scale) at the metal-oxide interface.

Aluminum and silicon also act to improve the oxidation resistance of stainless steels. It is thought that they act synergistically. U.S. Pat. No. 4,102,225 awarded to Michels on Jul. 25, 1978 provides a low-chromium containing alloy that is oxidation resistant. That alloy contains up to 4.5 percent aluminum, and up to 4.5 percent silicon with a combined silicon-plus-aluminum content of 2 to 7 percent.

Both aluminum and silicon concentrate in alloy substrates at the oxide scale/metal interface. However, silicon concentrates as metal while aluminum concentrates largely as an oxide. The aluminum oxide has been shown to disrupt the formation of the silicon oxide protective scale beneath the outer chromium layer discussed supra. The inventors believe that this disruption of the silicon layer compromises oxidation resistance, particularly at temperatures between 700° C. and 800° C.

Stainless steels exist which confer high oxidation resistance at or above 700° C. However, these steels contain higher amounts of chromium and nickel, or additions of rare earth elements and other expensive additives. U.S. Pat. No. 4,063,935 awarded on Dec. 20, 1977 and U.S. Pat. No. 4,108,641 awarded on Aug. 22, 1978, both to Fujioka, et al., require a combination of silicon and rare earth elements to confer resistance above 1100° C.

A need exists in the art for a low-cost oxidation resistant alloy and a method for producing an alloy that displays superior oxidation resistance. The alloy should contain relatively small amounts of chromium or nickel compared to the premium stainless steel alloys now available. Furthermore, the alloy should be resistant to oxidation at temperatures above 700° C.

SUMMARY OF THE INVENTION

It is an object of the invention to provide an oxidation resistant alloy and a method for producing the alloy that overcomes many of the disadvantages of the prior art.

Another object of the invention is to provide an oxidation resistant alloy. A feature of the invention is the formation and presence of a continuous, defect-free layer of silicon-oxide and the absence of any aluminum. The absence of aluminum allows for the formation of higher amounts of silicon oxide films. Another feature is that the full austenitic microstructure of the alloy is maintained despite the silicon additions. An advantage of the invention is that the alloy has oxidation resistance characteristics at 800° C. normally seen at 700° C.

Yet another object of the present invention is to provide a method for producing a highly oxidation-resistant alloy. A feature of the method is subjecting an alloy to a pretreatment heating step at a first temperature to produce an oxide protective layer which is not produced at a lower temperature. An advantage of the invention is that the pretreatment step increases oxidation resistance of the alloy vis-a-vis untreated alloy and therefore extends the use of relatively low-cost conventional 18-8 type stainless steels in the temperature range between 700° C. and the pretreatment temperature of 800° C.

Briefly, the invention provides for a method for producing an oxidation-resistant alloy, the method comprising providing an alloy comprising iron, chromium, nickel, manganese, molybdenum, and silicon; and heating the alloy to 800° C. prior to use.

Also provided is a fully austenitic alloy containing no aluminum, the alloy comprising iron, chromium, nickel, manganese, molybdenum and silicon.

The invention also provides a method for producing oxidation-resistant alloy for use at temperatures below 800° C., the method comprising providing an alloy comprising iron, chromium, nickel, manganese, molybdenum, and silicon; and heating the alloy at a temperature and for a time sufficient to form a continuous oxide film on a surface of said alloy.

BRIEF DESCRIPTION OF THE DRAWING

The invention together with the above and other objects and advantages will be best understood from the following detailed description of the preferred embodiment of the invention shown in the accompanying drawing, wherein.

DETAILED DESCRIPTION OF THE INVENTION

A new alloy has been developed having superior oxidation resistance. Also developed is a pretreatment process to produce alloys with better oxidation resistance at higher temperatures than the oxidation resistance normally displayed by untreated alloys at lower temperatures. The invented alloys, and alloys produced via the invented process, can be melted, forged and rolled to standard forms by the complete range of standard commercial techniques via standard commercial practice and conventional prior art.

The invented alloys and the alloys produced via the invented method showed markedly improved performance in oxidation resistance between 700° C. and 800° C. It is this temperature range where conventional stainless steels are performance limited. The temperature increase from 700° C. to 800° C. is a large temperature increase for lean chromium alloys and is typically in the temperature range where oxidation resistance fails catastrophically.

The inventors found that a critical factor in their alloy design is microstructure control. Microstructural variations effect mechanical properties, weldability, and oxidation/corrosion behavior. Over the compositional ranges of interest, the microstructure of the alloys could contain austenite phase (i.e., face-center cubic), ferrite phase (i.e. body center cubic), or both of these phases.

Invented Alloy

Substrate Detail

The invented alloy represents an austenitic microstructure. The inventors surmise that the austenitic crystal structure of their alloy provides a closely packed crystal structure which confers high temperature resistence and strength. Both silicon and aluminum are potent ferrite stabilizers. As such, quantities of Si and Al that can be added without ferrite formation are limited.

Specifically, the invented alloy substrate comprises a lean (less than 18 weight percent) chromium stainless steel alloy which shows oxidation resistance typically seen in more expensive stainless steel substrates. The inventors found that alloys of the base composition with only silicon added behaved completely differently during oxidation testing at 700° C. and 800° C. compared to alloys containing both silicon and aluminum.

Figure 1:
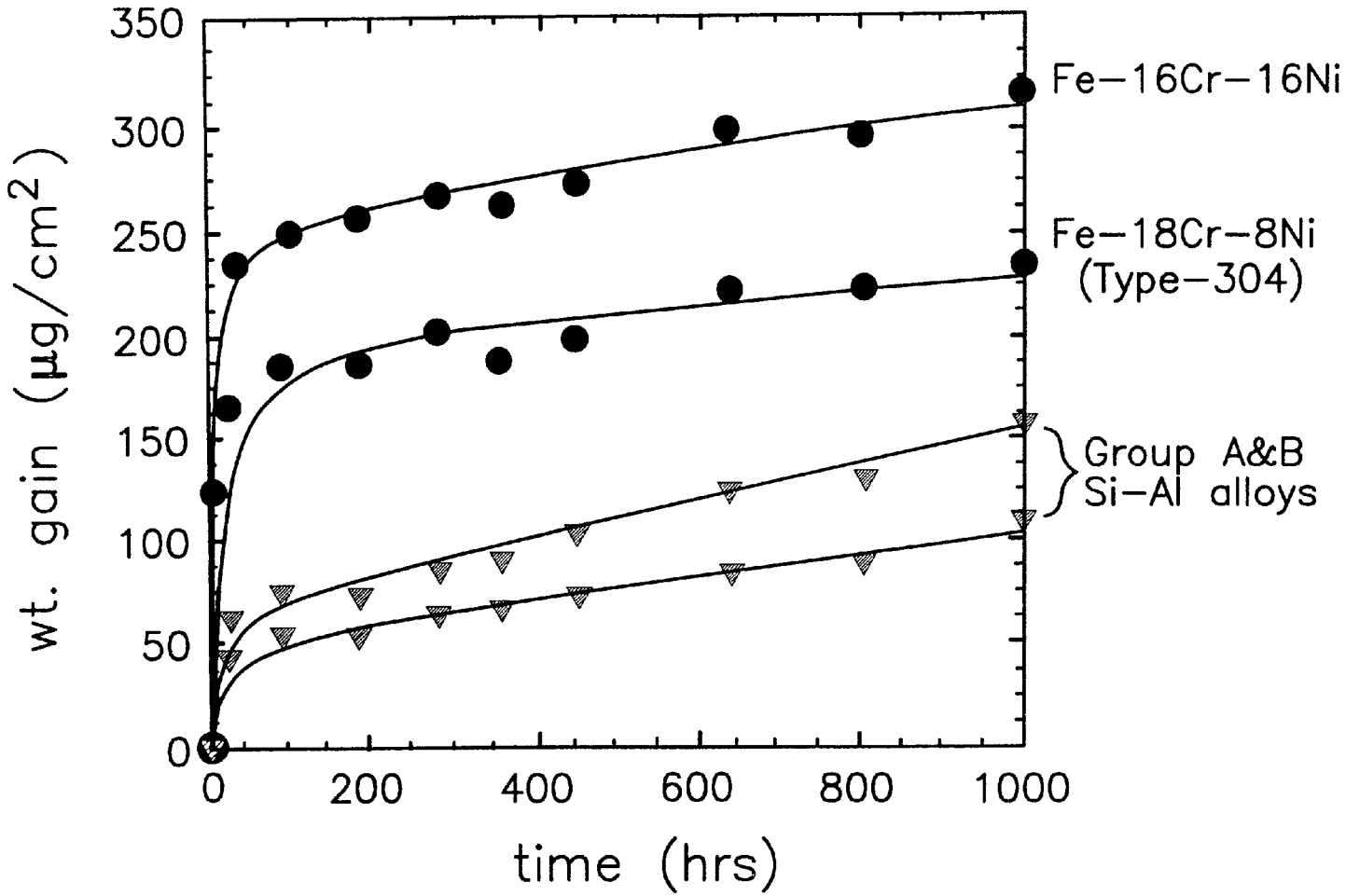
FIG. 1 is a graph depicting weight gain during heating to 700° C. of alloys containing silicon, alloys containing aluminum and silicon, and of conventional alloys, in accordance with features of the present invention.
Figure 2:
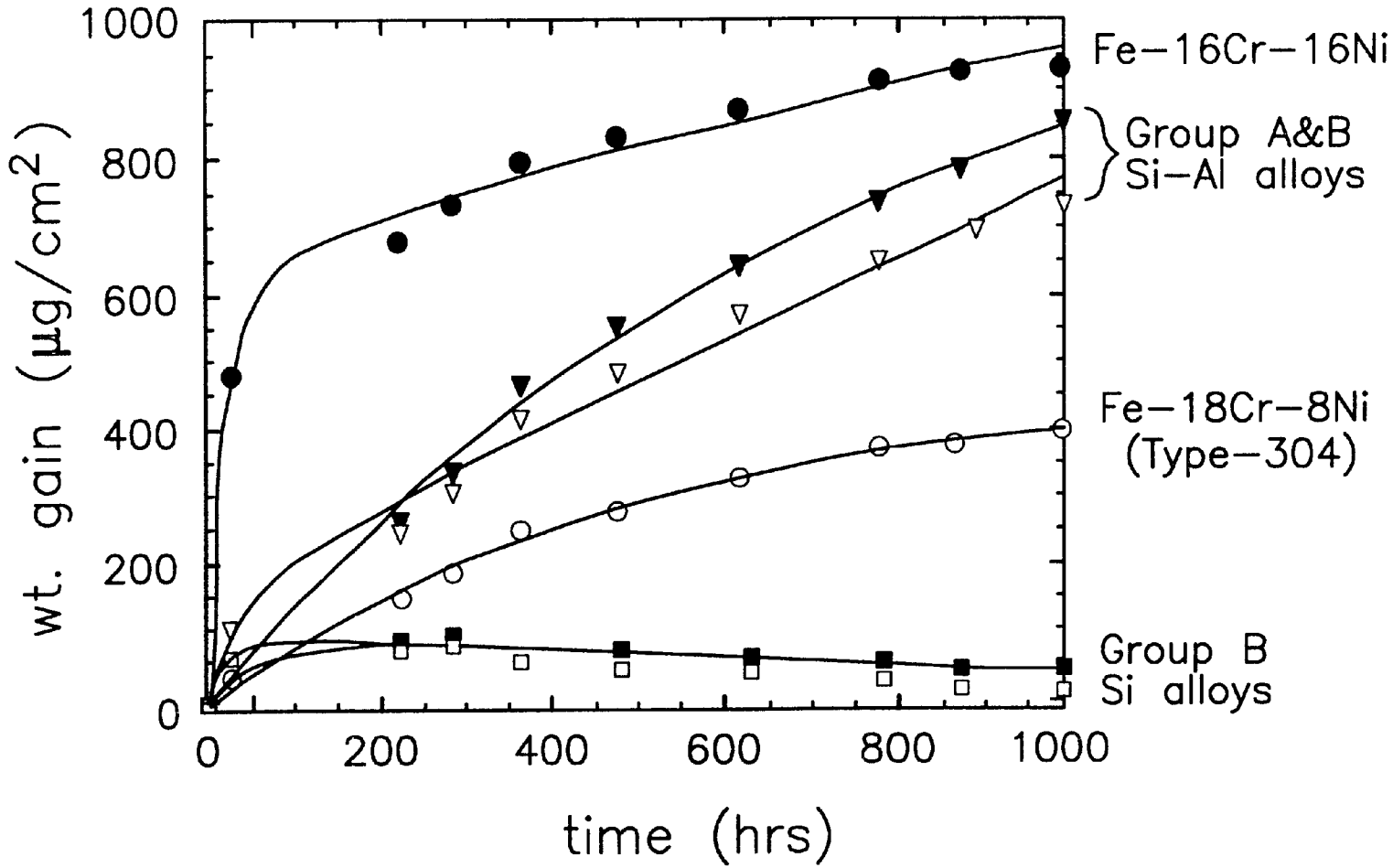
FIG. 2 is a graph depicting weight gain during heating to 800° C., of alloys containing silicon but no aluminum compared to conventional alloys and alloys containing silicon and aluminum, in accordance with features of the present invention.

For example, and as illustrated in FIG. 1, alloys containing silicon (Group B), and alloys containing aluminum and silicon (Group A) display better oxidation resistance at 700° C. than more typical stainless steels or alloys. However, and as depicted in FIG. 2, only silicon alloys (Group B) performed better than conventional stainless steel at 800° C. This indicates that different protective mechanisms are present at 800° C. for alloys with silicon only compared to alloys with both silicon and aluminum.

Surprisingly and unexpectedly, the inventors found that the oxidation performance for their alloys having 2 weight percent silicon or 3 weight percent silicon exhibited higher resistance at 800° C. than at 700° C. This indicates that new protective oxidation film kinetics controls the oxidation process of these invented substrates at 800° C.

The addition of silicon in the weight percents specified infra confer solid solution strengthening to typical alloys. Furthermore, the silicon additions do not inhibit the use of other strengthening mechanisms, such as carbide strengthening.

Generally, the invented alloys have the approximate base composition Fe—16Cr—16Ni—2Mn—1Mo, wherein Chromium represents 16 weight percent, Nickel 16 weight percent, Manganese 2 weight percent, Molybdenum 1 weight percent, and Iron the remainder. This base composition allows for additions of approximately four weight percent silicon, while retaining a fully austenitic structure. Generally, a resulting substrate containing less than four percent ferrite is considered by the inventors as suitably austenitic. Optionally, minor secondary carbide forming elements, such as titanium, niobium, vanadium, and carbon are added for precipitation strengthening via the formation of fine carbide dispersions. These secondary additions add up to less than one weight percent.

The materials discussed in the present invention were prepared with high purity alloying addition by standard vacuum induction melting. Ingots were produced for laboratory testing, ranging in size from 1 to 5 kilograms.

Pretreatment

Detail

The pretreatment step comprises subjecting alloy substrate to a temperature of approximately 800° C. and for between 175 and 250 hours. This pretreatment protocol is essentially a preoxidizing procedure wherein the surface is oxidized with oxide films (primarily silicon oxides and chromium oxides) not formed at lower temperatures. The pretreatment process provides exceptional oxidation resistance at 700° C. heretofore not seen with alloys of this quality and constituency.

In summary, at 800° C., the inventors detected the formation of uniquely protective oxide films, which do not form at 700 C. These unique films significantly slow the oxidation rate of alloys at 800 C. compared to typical alloys subjected to 800 C. temperatures. Furthermore, pretreatment at 800° C. confers higher oxidation resistance at 700° C. than seen in typical alloys subjected to 700° C.

The inventors preoxidized specimens at 800° C. for 190 hours in ambient atmosphere. As more fully discussed infra, this pretreatment step conferred oxidation resistance to the alloy such that zero weight gain of the alloy occurred after 1000 hours of exposure to 700° C.

Figure 3:
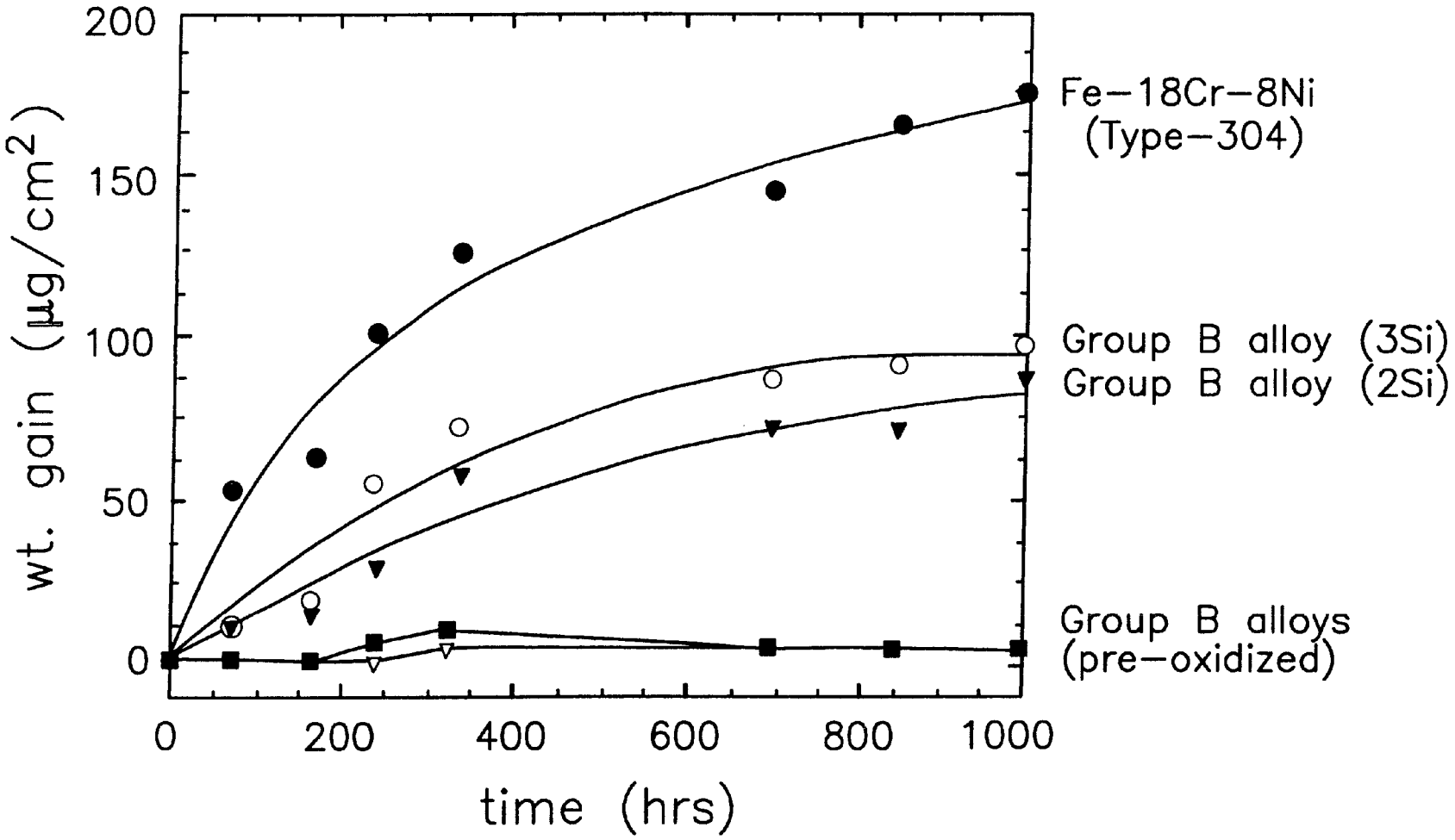
FIG. 3 is a graph comparing weight gain during heating to 700° C. of conventional alloys, alloys containing silicon with no pretreatment, and alloys pre-treated at 800° C. before use, in accordance with features of the present invention.

Reduced weight gains in the invented alloys reflect improved oxidation resistance, as depicted in FIGS. 2–3. For example, FIG. 2 shows that at 800° C., alloys with silicon and no aluminum have one-fourth the weight gain seen in conventional type 304 stainless steel. Compared to baseline alloy (i.e., substrate containing no aluminum or silicon), the invented substrate exhibited only one-tenth to one-eighth the weight gain.

Surprisingly and unexpectedly, the inventors found that alloys with both silicon and aluminum additions experienced a two-fold increase in weight compared to conventional 304 stainless steel.

EXAMPLE 1

A series of stainless steel alloys with a base composition of Fe—16Cr—16Ni—2Mn—1Mo with varying additions of Si and Al were melted as 1 kg charges. The alloys were forged and rolled at 1075° C. to 0.3 inch plate. 1 inch by 1 inch by 0.3 inch thick specimens were machined, finished to a 400-grit surface finish and prepared for oxidation testing together with a sample of type 304 stainless steel.

Table 1 shows the nominal composition of the alloy series together with the mag-netic response of the specimens. The alloys were all non-magnetic except for a very slight magnetic response in the 3Si—1Al and 2Si—2Al compositions indicating fully auste-nitic micro-structures except for small ferrite contents in the latter two compositions.

Data from oxidation tests of the invented alloy series are shown in FIG. 2 at 800° C. Alloys with Si and Al additions (i.e. Group A alloys) exhibit weight ains approximately 2× more than that of 18Cr—8Ni (type 304) after 1000 hours. The Group A alloy data is encompassed by the two boundary curves shown therefor.

Alloys with Si alone (Group B) exhibited one-eighth the weight gain seen with the Si plus Al alloys and one-ninth that seen with a base composition containing no Si and Al additions.

TABLE 1

Nominal Alloy Composition (wt. Pct.) For Oxidation/Sulfidation Resistant alloys.

| | Element | | | | | | | |
|---|---|---|---|---|---|---|---|---|
| Alloy | Fe | Cr | Ni | Mo | Mn | Si | Al | Magnetic Response |
| 1 | bal | 16 | 16 | 1 | 2 | 0 | 0 | NM |
| 2 | bal | 16 | 16 | 1 | 2 | 3 | 0 | NM |
| 3 | bal | 16 | 16 | 1 | 2 | 3 | 1 | SM |
| 4 | bal | 16 | 16 | 1 | 2 | 2 | 0 | NM |
| 5 | bal | 16 | 16 | 1 | 2 | 2 | 1 | NM |
| 6 | bal | 16 | 16 | 1 | 2 | 2 | 2 | SM |
| 7 | bal | 16 | 16 | 1 | 2 | 1 | 1 | NM |

Key
NM = non magnetic
SM = slightly magnetic

The temperature increase from 700° C. to 800° C. is a large temperature increase for lean chromium alloys and is typically in the temperature range where oxidation protection fails catastrophically. However, oxidation performance of the invented 2Si and 3Si alloys at 800° C. are equivalent or better than at 700° C. This indicates that a new protective oxidation film kinetics control the oxidation process at 800° C.

EXAMPLE 2

A second series of alloys with a base composition Fe—16Cr—16Ni—2Mn—Mo with varying additions of Si and Al were melted as 5 kg charges. Table 2 shows the nominal compositions of the alloys all of which were non-magnetic. A non-magnetic alloy means a single phase austenitic micro structure has been achieved. The alloys were forged and rolled to 0.3 inch plate at 1075° C. and 1-inch by 1-inch by 0.3 inch specimens were machined for oxidation testing. Samples were finished to a 400 grit surface finish prior to oxidation testing.

Specimens with 2 weight percent Si— and 3 weight percent Si-additions were preoxidized for 190 hours at 800° C. then removed. These preoxidized specimens were then tested at 700° C. together with 2Si and 3Si specimens that had not been preoxidized. A type 304 stainless steel specimen was a standard.

Results are shown in FIG. 3. Weight gain for the 2Si and 3Si alloys was reduced by a factor of 2 compared to type 304 stainless steel. However, the preoxidized 2Si and 3Si alloys show no significant weight gain whatsoever, even after 1000 hours at 700° C. This again shows that oxide layers formed at 800° C. are significantly more protective than those formed at 700° C. When these protective oxide layers are formed at 800° C. by a 190 hour preoxidation treatment the protective oxides are completely protective at 700° C. for exposures to 1000 hours.

TABLE 2

Nominal Alloy Composition (wt. Pct.) For Oxidation/Sulfidation Resistant alloys.

| | Element | | | | | | |
|---|---|---|---|---|---|---|---|
| Alloy | Fe | Cr | Ni | Mo | Mn | Si | Al |
| 8 | bal | 16 | 16 | 1 | 2 | 0 | 0 |
| 9 | bal | 16 | 16 | 1 | 2 | 3 | 0 |
| 10 | bal | 16 | 16 | 1 | 2 | 3 | 1 |
| 11 | bal | 16 | 16 | 1 | 2 | 2 | 0 |
| 12 | bal | 16 | 16 | 1 | 2 | 2 | 1 |
| 13 | bal | 16 | 16 | 1 | 2 | 1 | 1 |

EXAMPLE 3

Specimens were prepared for analysis by ESCA (electron spectroscopy for chemical analysis). Specimens with 3Si and 2Si-2Al additions that had under-gone 1000 hour oxidation tests at 800° C. were prepared for analysis. The corner of the 1-inch by 1-inch by 0.3-inch samples were ground at a 45 degree angle. Examination of the oxide films and areas immediately adjacent to the oxide films were analyzed. The areas analyzed were identified as oxide film or base metal.

Analysis revealed the atomic percent of each element present and this was broken down into the atomic percent present at various binding energies. Thus an estimate could be made as to whether an element was present as an unassociated element metal or as an oxide. Data for the two specimens are shown in Tables 3 and 4.

For a given element, concentrations in atomic percent are listed in order of increasing binding energy. Thus the first concentration listed will usually be associated with the element in elemental form while below it are concentrations associated with the element in the form of an oxide.

As depicted in Tables 3 and 4, elemental Silicon (not Silicon oxide) exists in the bulk metal at the interface between the bulk metal and the oxide scale. In the 3 Si alloy, generally, 5.6 atomic percent of the bulk metal is silicon. However, toward the interface, 10.6 atomic percent of the bulk metal is silicon. No silicon was detected as an oxide in the bulk metal near the interface. In the oxide scale present, 1.1 atomic percent is elemental silicon and 1.9 weight percent as silicon oxide.

The elemental concentrations determined were consistent with a protective oxide layer consisting primarily of chromium oxides. The oxide layer is rich in Mn and Cr in the form of oxides. This results in the depletion of Cr and Mn in the metal region near the oxide-metal interface. In the case of Mn, depletion is almost complete. In the Si-only composition, a significant concentration of silicon occurs adjacent to the oxide-metal interface. However, in the thin fringe area adjacent to the interface, silicon oxide is observed. In the Si- and Al-containing alloy (Table 4), similar characteristics for Si are observed together with an even greater concentration of Al as an oxide at the oxide-metal interface.

The rate of oxidation and growth of the oxide film appear to be dominated by the outward diffusion of Cr and Mn from the base metal through the oxide-metal interface and leading to a depletion of the elements in the base metal. This diffusion mechanism may be controlled eventually by the formation of a thin layer of $SiO_2$ at the oxide-metal interface supported by a concentration of Si in the base metal adjacent to the interface. The continuity of the Si oxide film and its effect on oxidation kinetics could be disrupted in Al containing alloys by the formation of aluminum oxide internal oxidation in the base metal concentrated near the oxide metal interface.

TABLE 3

Electron Spectroscopy for Chemical Analysis (ESCA) data for Fe—16Cr—16Ni—2Mn—1Mo—3Si alloy.

| | COMPOSITION BASE | | COMPOSITION (ATOMIC %) | |
|---|---|---|---|---|
| ELEMENT | WT % | ATOM % | BASE METAL | OXIDE FILM |
| Fe | 62 | 60.2 | 45.9 | 3.8 |
| | | | 9.7 | 3.4 |
| Cr | 16.1 | 16.8 | 10.4 | 2.3 |
| | | | 1.3 | 18.3 |
| Ni | 16.3 | 15.1 | 9.6 | 1.6 |
| | | | 2.0 | |
| Mn | 2.0 | 1.9 | 0 | 11.3 |
| Mo | 0.7 | 0.4 | 0 | 0.1 |
| Si | 2.9 | 5.6 | 10.6 | 1.1 |
| | | | 0 | 1.9 |
| Al | — | — | | |
| O | — | — | 4.4 | |
| | | | 1.3 | 50.5 |
| C | — | — | 2.7 | 5.8 |
| | | | 0.8 | |

TABLE 4

Electron Spectroscopy for Chemical Analysis (ESCA) Data for Fe—16Cr—16Ni—2Mn—1Mo—2Si—2Al Alloy.

| | COMPOSITION BASE | | COMPOSITION (ATOMIC %) | |
|---|---|---|---|---|
| ELEMENT | WT % | ATOM % | BASE METAL | OXIDE |
| Fe | 59.9 | 57.3 | 29.2 | 2.7 |
| | | | 7.1 | 1.7 |
| Cr | 16.1 | 16.5 | 8.1 | |
| | | | 1.5 | 21.0 |
| Ni | 16.3 | 14.8 | 6.7 | 1.2 |
| Mn | 2.3 | 2.2 | 0 | 9.0 |
| Mo | 1.1 | 0.6 | 1.3 | 0.2 |
| Si | 2.1 | 3.96 | 9.6 | 1.0 |
| | | | | 4.5 |
| Al | 2.2 | 4.4 | 14.8 | 2.3 |
| O | — | — | 16.7 | 48.8 |
| | | | | 3.2 |
| C | — | — | 5.1 | 4.3 |

EXAMPLE 4

In addition to providing improved oxidation resistance, additions of Si provide solid solution strengthening to the alloy. The Si additions do not inhibit the use of other strengthening mechanism such as carbide strengthening.

Table 5 shows tensile strenghts (both longitudinal and transverse) of alloys with 2Si and 3Si additions compared with the base composition having no Si or Al additions. Data for alloys with 0.3Ti-0.1Ni-0.5V-0.8C carbide forming strengthening additions are a;so included. It can be seen that the 2Si and 3Si additions provide a solid solution strengthening component which is further enhanced by th carbide forming additions. Both the yield strength and the ultimate tensile strength are improved.

TABLE 5

| Composition | longitudina | UTS (Mpa) | yield (Mpa) | RA (%) | elongation (%) |
|---|---|---|---|---|---|
| base | longitudina | 481.3 | 170.8 | 74.98 | 66.34 |
| (16Cr—16ni—2Mn—1Mo) | transverse | 466.0 | 165.2 | 75.32 | 62.18 |
| | transverse | 462.7 | 160.3 | 75.51 | 65.25 |
| | transverse | 462.1 | 161.9 | 73.86 | 66.03 |
| base + 2 Si | longitudina | 524.9 | 178.0 | 81.12 | 80.39 |
| | transverse | 527.1 | 186.9 | 79.83 | 63.89 |
| | transverse | 530.3 | 188.7 | 82.03 | 80.39 |
| | transverse | 516.7 | 184.6 | 80.76 | 84.71 |
| base + 3 Si | longitudina | 577.6 | 198.4 | 79.98 | |
| | transverse | 560.1 | 188.6 | 75.68 | 83.54 |
| | transverse | 558.1 | 189.2 | 76.96 | 83.23 |
| | transverse | 546.5 | 179.3 | 78.36 | 96.58 |
| base + 2 Si + xx | longitudina | 628.1 | 294.5 | 68.45 | 67.24 |
| (xx = 0.3Ti—0.1Nb—0.5V—0.8C) | transverse | 592.2 | 227.0 | 65.89 | 65.14 |
| | transverse | 610.7 | 250.2 | 68.07 | 67.12 |
| | transverse | 609.5 | 240.1 | 69.81 | 67.90 |
| base + 3 Si + xx | longitudina | 644.0 | 246.9 | 67.09 | 74.36 |
| | transverse | 652.2 | 268.4 | 65.66 | 69.42 |
| | transverse | 657.3 | 266.3 | 63.68 | 65.45 |
| | transverse | 648.5 | 245.9 | 61.03 | 65.25 |

While the invention has been described with reference to details of the illustrated embodiment, these details are not intended to limit the scope of the invention as defined in the appended claims.

The embodiment of the invention in which an exclusive property or privilege is claimed is defined as follows:

1. A method for producing oxidation-resistant alloys for use at temperatures below 800° C., the method comprising:

a) providing an alloy comprising, by weight %: 14–18% chromium, 15–18% nickel, 1–3% manganese, 1–2% molybdenum, and 2–4% silicon, the balance being iron; and b) heating the alloy to 800° C. for between 175–250 hours prior to use, c) forming a continuous silicon oxide film on a surface of said alloy that protects against oxidation d) forming another oxide over the silicon oxide film.

2. The method as recited in claim 1 wherein the austenitic microstructure of the alloy is maintained.

3. The method as recited in claim 1 wherein the alloy contains no aluminum.

4. The method as recited in claim 1 wherein the other oxide formed over the silicon oxide film is chromium oxide.

5. The method as recited in claim 1 wherein the step of heating the alloy imparts an oxidation rate controlling mechanism upon the alloy which operates at 700° C.

6. A method for producing oxidation-resistant alloy for use at temperatures below 800° C., the method comprising:

a) providing an alloy comprising, by weight %: 14–18% chromium, 15–18% nickel, 1–3% manganese, 1–2% molybdenum, and 2–4% silicon, the balance being iron; and b) heating the alloy at a temperature and for a time sufficient to form a continuous silicon oxide film on a surface of said alloy that protects against oxidation, c) forming another oxide over the silicon oxide film.

7. The method as recited in claim 6 wherein the temperature is 800° C. and the time is between 175–250 hours.

8. The method as recited in claim 6 wherein the austenitic microstructure of the alloy is maintained.

9. The method as recited in claim 6 wherein the other oxide formed over the silicon oxide film is chromium oxide.

* * * * *